United States Patent [19]

Adams et al.

[11] Patent Number: 5,026,270

[45] Date of Patent: Jun. 25, 1991

[54] MICROCONTROLLER AND SYSTEM FOR CONTROLLING TRIAL TIMES IN A FURNACE SYSTEM

[75] Inventors: John T. Adams, Minneapolis; Timothy M. Tinsley, Coon Rapids, both of Minn.

[73] Assignee: Honeywell Inc., Minneapolis, Minn.

[21] Appl. No.: 569,872

[22] Filed: Aug. 17, 1990

[51] Int. Cl.[5] ..... F23N 1/00

[52] U.S. Cl. ..... 431/24; 431/27; 431/69

[58] Field of Search ..... 431/24, 27, 69

[56] References Cited

U.S. PATENT DOCUMENTS

| | | | |
|---|---|---|---|
| 3,954,383 | 5/1976 | Bryant . | |
| 4,319,873 | 3/1982 | Michaud et al. . | |
| 4,359,315 | 11/1982 | Matthews . | |
| 4,518,345 | 5/1985 | Mueller et al. | 431/24 |
| 4,695,246 | 9/1987 | Beilfuss et al. | 431/69 |
| 4,832,594 | 5/1989 | Youtz | 431/24 |
| 4,854,852 | 8/1989 | Patton et al. . | |
| 4,865,538 | 9/1989 | Scheele et al. | 431/24 |

*Primary Examiner*—Carroll B. Dority

*Attorney, Agent, or Firm*—Robert B. Leonard

[57] ABSTRACT

A microcontroller and system allowing for more than one trial time in a furnace system, while using only one pin of the microcontroller. An alternating current signal at an input port of the microcontroller causes the microcontroller to allow a first long trial time period. Any direct current signal at the input port causes the microcontroller to allow only a second shorter trial time period. The trial time input port of the microcontroller is placed between two ports which either receive or send direct current signals. Due to this arrangement of the parts and construction of the microcontroller, the microcontroller will fail to the shorter and safer trial time if a fault causes an erroneous signal to appear at the input port.

9 Claims, 1 Drawing Sheet

| | | | |
|---|---|---|---|
| IRQ CHECK | 100 | TIMERS | 103 |
| IRQ AND TRIAL TIME COMPARISON | 101 | | |
| TRIAL TIME SELECT | 102 | MEMORY | 104 |

5

MICROCONTROLLER AND SYSTEM FOR CONTROLLING TRIAL TIMES IN A FURNACE SYSTEM

BACKGROUND OF THE INVENTION

This invention is directed toward the field of furnace controls, and more specifically to the field of trial timers and controllers.

Standard furnace systems usually included a solenoid operated valve (SOV) to control gas flow into a combustion chamber. To control the operation of the SOV, a microcontroller was often used in a furnace control system so that the SOV may be opened and closed at appropriate times.

One time when it was desirable to open the SOV was during ignition of the furnace, also known as a trial. If the furnace did not ignite within a preselected amount of time, usually four or six seconds after the start of the trial, it was desirable to end the trial and close the SOV. Well known flame sense circuitry was included in the furnace control system to sense flame during a trial, and to keep the SOV open once flame was sensed.

Yet, flame was not always created during a trial, and it was left to the microcontroller to end a trial and close the SOV in such a case. As was stated earlier, most furnace manufacturers specified either a four or six second trial time for their furnaces. Thus, a manufacturer of microcontrollers for furnaces had to create a microcontroller which could handle either trial time period. Generally, this resulted in a microcontroller which had two pins, one which would be connected to get a four second trial and one for the six second trial.

Problems were created in that to meet certain certification requirements, any failure of the microcontroller had to lead to the shorter or four second trial time period. Failure which led to a six second trial time period could have caused a serious explosion which could lead to personal injury and property damage.

Lastly, only a limited number of pins were available on the microcontroller.

Thus, it is an object of the present invention to provide a furnace control which fails to a four second trial time. It is a further object of the present invention to provide a furnace control which only requires one pin on the microcontroller to control the trial time period.

SUMMARY OF THE INVENTION

The present invention is a furnace control system including a microcontroller, which fails to a short trial time. The microcontroller includes an input port, an output port and a trial time select means which opens a SOV for a long trial time if an alternating current signal is received at the input port. The microcontroller opens the SOV for a short time period otherwise.

DETAILED DESCRIPTION OF THE PREFERRED EMBODIMENT

Figures 1, 2:
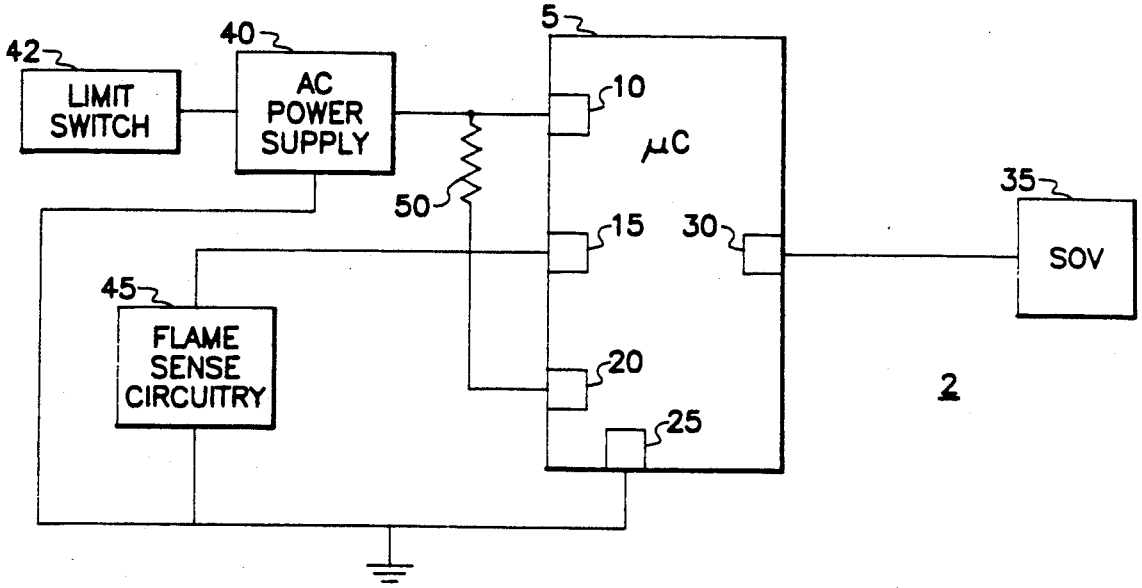
FIG. 1 is a block diagram of the furnace control system of the present invention.
FIG. 2 is a partial block diagram of the architecture of the microcontroller of FIG. 1.

Referring now to FIG. 1, thereshown is a block diagram of the present furnace control system 2. At the heart of furnace control system 2 is microcontroller 5. Microcontroller 5 includes first input port 10, second input port 15, third input port fourth input port 25 and output port 30.

First input port 10 is also known as the interrupt request (IRQ) port, and receives an alternating current signal from voltage supply 40. A preferred embodiment has the output of the voltage supply 40 being a 5 V, 60 Hz, square wave. Voltage supply 40 is also connected to limit switch 42. Generally, limit switches open when a fault is detected in the system. If limit switch 42 opens, the output from voltage supply 40 is terminated.

Second input port 15 is connected to flame sense circuitry 45. During a trial, if flame is sensed, flame sense circuitry 45 produces a signal indicative of the presence of flame. Second input port 15 receives this signal and thereby prevents microcontroller 5 from shutting SOV 35.

Third input port 20 is connected through resistor 50 to power supply 40, in this embodiment. The signal received at third input port 20 controls the length of the trial period. If a signal having a predetermined frequency such as a 60 Hz square wave is received at third input port 20, the trial time period will be long, for example six seconds. If any other signal is received at the third input port 20, the trial time period will be short, such as four seconds.

Fourth input port 25 is tied to the power supply 40 and the flame sense circuitry 45, as well as ground. Output port 30 is connected to a control line of Solenoid Operated Valve (SOV) 35. Through output port 30, SOV 35 can be opened and closed as required by the microcontroller 5.

For proper operation of the control system, it is necessary for the microcontroller to perform certain functions. Thus, the architecture of the microcontroller will be described. The microcontroller will be better understood with reference to FIG. 2.

In FIG. 2, the microcontroller 5 is shown as including at least five parts: IRQ Monitor 100, IRQ and Trial Time Comparator 101, Trial Time Select 102, Timers 103 and Memory 104. These parts will now be described.

IRQ Monitor 100 insures that the signal received at first input port 10 is an alternating current signal. The timers 103 cause sampling of the voltage level of the signal received at first input port 10 at preselected times. The IRQ Monitor 100 then compares the sampled voltage levels with predetermined voltage levels stored in memory 104. If there is a mismatch between the sampled and stored voltage levels, the IRQ monitor 100 is adapted to prevent any further operation of the microcontroller 5. Alternatively, because power supplies are imperfect, the IRQ Monitor 100 may be adapted to allow a predetermined number of mismatches between the sampled and stored voltage levels before causing the microcontroller to shut down.

IRQ & Trial Time Comparator 101 insures that the third input port is receiving an alternating current signal having the correct frequency, before the microcontroller allows a long trial time period. Because the third input port 20 controls the trial time length, and it receives a signal from power supply 40 through resistor 50, the third input port 20 should receive the same frequency signal as the first input or IRQ port 10. By comparing the inputs at the first and third input ports 10, 20, the microcontroller insures that an appropriate frequency signal is present at the third input port before a long trial time period is permitted.

The trial time select means 102 communicates with the IRQ & Trial Time Comparator 101 to decide which trial time period to use. If the IRQ & Trial Time Comparator determines that the third input port 20 is receiving an alternating current signal of an appropriate frequency, then the trial time select means will permit a long trial time period. Otherwise, the trial time select means will permit only a short trial time period.

It should be noted that a preferred embodiment has the third input port located between the fourth input port and the second input port. By physically arranging the ports in this way, should the third input port be shorted to either of its neighbors, it will fail in the direction of the shorter trial time. The fourth input port is tied to ground, thus if shorted to the third input port, will cause a short trial time period. The second input port is connected to flame sense circuitry which will produce either a steady high or low level signal depending upon the presence of flame. Either output from the flame sense circuitry, if shorted to the third input port, would cause a short trial time period.

The foregoing has been a description of a novel and non-obvious furnace control system having a fail safe trial time selection means. The inventors do not intend to limit their invention to the foregoing description, but instead define their invention by the claims appended hereto.

We claim:

1. A microcontroller for controlling the operation of a gas valve in a furnace during a trial, comprising:

an input port adapted to receive electrical signals, and;

trial time select means connected to the gas valve, said trial time select means being adapted to open the gas valve for a first time period during a trial when an alternating current signal is received at said input port, said trial time select means being further adapted to open the gas valve for a second time period when a direct current signal is received at said input port.

2. The microcontroller of claim 1, wherein said input port is physically located between two ports of said microcontroller, said two ports being adapted to receive direct current signals.

3. The microcontroller of claim 1, wherein said first time period is longer than said second time period.

4. The microcontroller of claim 3 wherein said first time period is 6 seconds and said second time period is four seconds.

5. A microcontroller for controlling the operation of a gas valve in a furnace during a trial, comprising:

a first input port adapted to be connected to an alternating current voltage source;

a second input port adapted to receive electrical signals, and;

trial time select means being adapted to compare signals received at said first and second ports and to open the gas valve for a long time period during a trial if the signals at the first and second ports are alternating current signals having the same frequency, said trial time select means being further adapted to open the gas valve for a short time period during a trial, otherwise.

6. A furnace control system, comprising:

an electrically operable gas valve having a control line;

a microcontroller comprised of:

an input port adapted to receive electrical signals, and;

trial time select means having an output port connected to said control line, said trial time select means being adapted to open the gas valve for a first time period during a trial when an alternating current signal is received at said input port, said trial time select means being further adapted to open the gas valve for a second time period when a direct current signal is received at said input port.

7. The microcontroller of claim 6, wherein said input port is physically located between two ports of said microcontroller, said two ports being adapted to receive direct current signals.

8. The microcontroller of claim 6, wherein said first time period is longer than said second time period.

9. The microcontroller of claim 8 wherein said first time period is 6 seconds and said second time period is four seconds.

* * * * *